United States Patent [19]

Signori et al.

[11] Patent Number: 4,726,079

[45] Date of Patent: Feb. 23, 1988

[54] HEIGHT ADJUSTABLE TOILET BOWL

[76] Inventors: Jacques R. Signori, Courcilly Saint Ouen sur Morin; Hervé A. Blanchard, 13, Courcilly Saint Ouen sur Morin, both of Saint Cyr sur Morin, France

[21] Appl. No.: 66,187

[22] Filed: Jun. 25, 1987

[30] Foreign Application Priority Data

Jun. 27, 1986 [FR] France ..... 86 09337

[51] Int. Cl.[4] ..... E03D 11/00; E03D 11/12

[52] U.S. Cl. ..... 4/252 R; 4/312; 4/420; 4/645; 4/564; 4/DIG. 2

[58] Field of Search ..... 4/300, 307, 312, 420, 4/564, 566, DIG. 2, 645, 252 R, 251, 578, 579, 565, 560

[56] References Cited

U.S. PATENT DOCUMENTS

| | | | |
|---|---|---|---|
| 2,428,462 | 10/1947 | Levin | 4/312 |
| 2,527,270 | 10/1950 | Levin | 4/312 |
| 3,456,264 | 7/1969 | Flagg | 4/645 |
| 4,091,473 | 5/1978 | Matthews et al. | 4/251 |
| 4,174,546 | 11/1979 | Ohtake | 4/252 R |
| 4,185,335 | 1/1980 | Alvis | 4/578 |
| 4,419,776 | 12/1983 | Schmidt | 4/566 X |

*Primary Examiner*—Henry K. Artis

*Attorney, Agent, or Firm*—Roylance, Abrams, Berdo & Goodman

[57] ABSTRACT

A height adjustable toilet bowl is provided including a water actuated cylinder (10) for moving it between a low position and a high position, a cleaning water circuit (1) adapted to be connected to a water supply pipe (2), a hose (11) interposed between the cleaning water circuit (1) and the water supply pipe (2) and an outlet pipe (3) connected to a discharge duct (4) through an extensible pipe (12), wherein the water actuated cylinder (10) is a flexible cylinder connectable selectively to the water supply pipe (2) and to the cleaning water circuit (1) through a three position valve (13), a pipe (16) being interposed between the flexible cylinder and the three position valve.

9 Claims, 5 Drawing Figures

HEIGHT ADJUSTABLE TOILET BOWL

The present invention relates to a toilet bowl including a water actuated hydraulic cylinder for moving it between a low position and a high position, a cleaning water circuit adapted to be connected to a water supply pipe, a flexible pipe or hose interposed between the cleaning water circuit and the water supply pipe and an output pipe connected to a discharge duct through an extensive pipe.

U.S. Pat. No. 3,605,134 divulges a toilet bowl of this type whose water actuated cylinder has two chambers able to be connected selectively to the water supply pipe. This bowl has however the drawback of consuming large amounts of water. Its cylinder in fact requires a water charge for raising it and another for lowering it. The water discharged from the chambers of its cylinder is further discharged directly into the discharge pipe and is thus wasted. Moreover, the use of the hydraulic cylinder described comprises risks of breakdown or leaks because of the seizing up of the mobile members and sealing of the cylinder.

The present invention proposes overcoming this drawback and for this it provides a toilet bowl of the above mentioned type which is characterized in that the water actuated cylinder is a flexible cylinder able to be connected selectively to the water supply pipe and to the cleaing water circuit through a three position valve, a pipe being interposed between the flexible cylinder and the three position valve.

The toilet bowl of the present invention allows considerable saving in water since its hydraulic cylinder, which only has a single chamber, requires a water charge solely for bringing it to its high position. In addition, the water leaving its cylinder is fed into its water cleaning circuit and thus participates in maintaining it clean before being discharged into the discharge pipe. Furthermore, the flexible hydraulic cylinder uses no friction member so there is no possible risk of seizure.

In a particular embodiment, the bowl of the invention includes a fixed base provided with stops for supporting it when it is in its low position and vertical guide means for guiding it during its movements between its low and high positions, the flexible cylinder being interposed between the bowl and the fixed base.

With this set of arrangements, the bowl is maintained perfectly stable whatever the position in which it is situated, which is essential for the safety of its user.

To avoid an excessive amount of water being admitted into the hydraulic water actuated cylinder, this may advantageously include a travel limiter between its upper and lower walls, this travel limiter being for example formed by a cable which is stretched when the bowl reaches its top position.

The risks of the flexible hydraulic cylinder being accidentally damaged under the pressure of the water and thus removed.

In a second embodiment, the bowl of the invention includes, between a base resting on the ground and a plate fixed under its lower face, at least two arms hinged to one another about an axis equidistant from their ends, the ends of these two arms which are situated on the same side with respect to this axis being hinged respectively to the base and to the plate whereas their ends which are situated on the other side with respect to said axis are movable in slides fixed respectively on the base and on the plate.

When the bowl includes two pairs of parallel arms, the hydraulic cylinder may be interposed between a support plate connecting two parallel arms together and one of the elements of the group including the base and the plate.

It is moreover desirable for the two arms of the same pair to have lugs shaped so as to come into contact and form end of travel stops when the bowl reaches its top position. Because of these lugs, the risks that an excessive amount of water penetrates into the hydraulic clyinder are in fact removed which protects this latter against accidental damage.

When the bowl includes a cover mounted for pivoting between a lowered position and a raised position, automatic control means may be provided for causing the cover to pivot from its lowered position to its raised position when the hydraulic water actuated cylinder moves the bowl from its low position to its high position, and in the opposite direction when the water cylinder moves the bowl from its top to its low position.

The cover thus comes automatically to its raised position when the bowl is brought to its high position. Any manual contact with the cover is thus avoided. This latter is therefore protected against splashes of urine when the user uses the bowl as urinal.

Preferably, the control means include a lug extending the cover, rearwardly of the hinge axis thereof, a first cable one of the ends of which is fixed to the lug and the other end of which is connected to a first fixed spring adjacent the front part of the bowl, a second cable one of whose ends is fixed to the lug and the other end of which is connected to a second fixed spring adjacent the rear part of the bowl, the first spring being more resistant than the second, and a stop against which the lug bears when the cover is in its raised position, these control means being adapted so that the first cable is stretched when the bowl moves away from its low position, so that the second cable is streteched before the bowl reaches its top position and so that the first spring is tensioned after the second, when the lug comes to bear against the stop.

It should be noted that the toilet bowl of the invention may further include a water tank, this being either fixed to the bowl or independent, but in any case upstream of the water cleaning circuit. In some installations, the tank may be replaced by p iping of sufficient dimensions to provide a flow rate ensuring efficient cleaning. Furthermore, the discharge pipe of the bowl could be equipped with a grinder.

Two embodiments of the present invention will be described hereafter by way of examples which are in no wise limitative with reference to the accompanying drawings in which.

Figure 1:
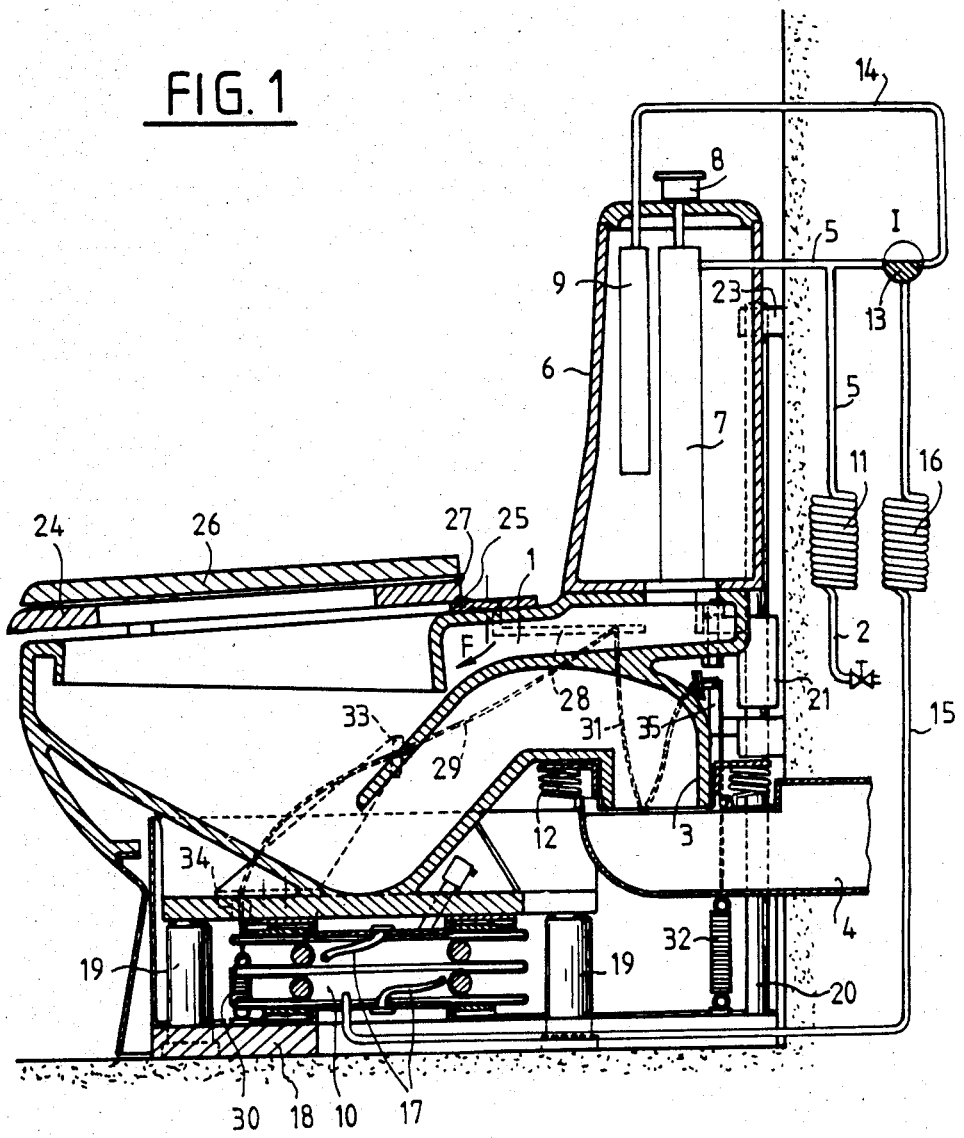
FIG. 1 is a schematical sectional view of a toilet bowl in accordance with the invention, this bowl being shown in its low position.
Figure 2:
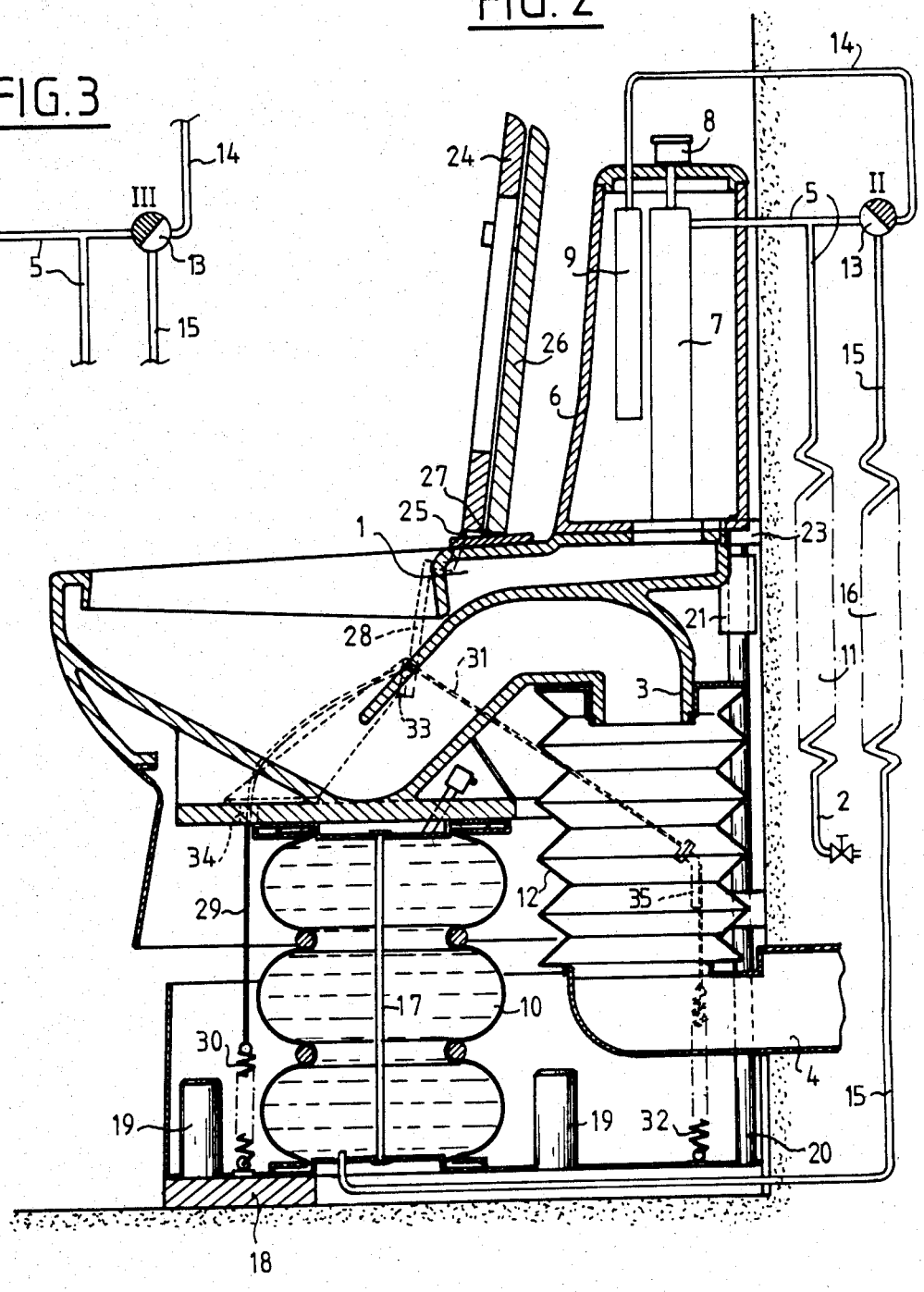
FIG. 2 is a view similar to that of FIG. 1, but showing the bowl in its top position.

The toilet bowl which is shown in FIGS. 1 and 2 includes, in a way known per se, a cleaning water circuit 1 adapted to be connected to a water supply pipe 2 and an outlet pipe 3 connected to a discharge duct 4.

In the example shown, the cleaning water circuit 1 is connected to pipe 2 through a pipe 5 and a conventional flushing system 6 having a filling system 7, an operating handle 8 and an overflow 9. The flushing system could however be replaced by any other tank or system without departing from the scope of the present invention.

The toilet bowl also includes a hydraulic water actuated cylinder 10 for moving it into a low position, as shown in FIG. 1, and a high position shown in FIG. 2, a hose 11 interposed between pipes 2 and 5 and an extensible pipe 12 interposed between the outlet pipe 3 and the discharge duct 4.

The flexible cylinder is connectable selectively to the supply pipe 2 and to the water cleaing circuit 1 through a three position valve 13 adapted for manual control by means of a pedal or remotely.

Valve 13 is situated at the level of the junction of pipe 5 with a pipe 14 connected to the overflow 9 of the flusing system and to a pipe 15 connected to the flexible hydraulic cylinder, this pipe being provided with a hose 16.

Valve 13 isolates pipes 2 and 5 from pipes 14 and 15 when it is in its position I shown in FIG. 1. The toilet bowl in this case remains stationary since only the filling system 7 of the flushing circuit is connected to the water supply pipe 2.

On the other hand, valve 13 connects pipe 15 to pipes 2 and 5 and isolates pipe 14 when it is in its position II shown in FIG. 2. In this case, water is admitted into the flexible hydraulic cylinder which raises the bowl while filling up with water.

The bowl has a travel distance of the order of 20 to 30 cm. It could however be immobilized in any position between its endmost positions. It would in fact be sufficient to replace valve 13 to its position I at a given time before it reaches its top position. Likewise, its rising speed could be adjusted by suitably adjusting the valve 13.

Figure 3:
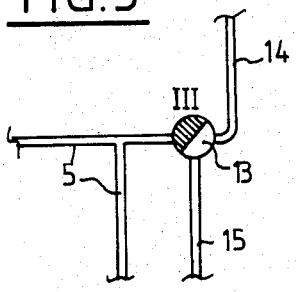
FIG. 3 is a detail view showing the valve in a position different from those which are shown in FIGS. 1 and 2.

Valve 13 connects pipes 14 and 15 together while isolating them from pipes 2 and 5 when it is in its position III shown in FIG. 3. In this case, the water contained in the flexible hydraulic cylinder is driven into the overflow 9 of the flushing system solely under the weight of the bowl and thus flows directly into the water cleaning circuit 1. It therefore participates in cleaning the bowl.

Valve 13 could of course be replaced in its position I for imobilizing the bowl in an intermediate position. The downward speed of the bowl could also be adjusted by suitably adjusting valve 13.

It will be noted here that the upper and lower walls of the flexible cylinder are connected by a travel limiter 17 formed here by a cable which is stretched only when the bowl reaches its top position. The maximum amount of water taken into the hydraulic cylinder may thus be limited, which avoids any risk of accidental damage thereto.

The toilet bowl shown in FIGS. 1 and 2 is further equipped with a fixed base 18 having stops 19 against which it comes to bear when it is in its low position shown in FIG. 1 and two vertical rods 20 (only one of which is shown) guiding it during its movements between its low and high positions, these rods being adjacent its rear part.

As can be clearly seen in these Figures, the flexible cylinder is fixed to base 18 and to a plate secured to the lower face of the bowl, respectively by its lower and upper walls.

The bowl also includes a sleeve 21 fitted on each of rods 20 which are provided with a top stop 23 so as to provide a second safety means should element 17 be defective. It is further provided, in a way known per se, with a seat 24 hinged about an axis 25 and a cover 26 itself hinged to the seat about an axis 27, the seat and the cover being situated on the same side with respect to their respective hinge axis.

In a conventional way, seat 24 may occupy a lowered position shown in FIG. 1 in which it extends substantially horizontally about the periphery of the bowl or a raised position shown in FIG. 2 in which it is adjacent the flushing system, its raised position forming an angle slightly greater than 90° with its lowered position.

Means, not shown, are advantageously provided for connecting the cover 26 to seat 24 and allowing these two elements to move together.

Control means are further provided for automatically moving the seat 24 and cover 26 from their lowered position to their raised position when the flexible hydraulic cylinder moves the bowl from its low position to its high position, and from their raised position to their lowered position when the bowl comes back to its low position.

In the embodiment shown, these control means include a lug 28 extending seat 24 beyond axis 25, a first cable 29 one of the ends of which is fixed to lug 28 and the other end of which is connected to a first spring 30 fixed to the front part of base 18, a second cable 31 one of whose ends is fixed to lug 28 and the other end of which is connected to a second spring 32 fixed to the rear part of base 18, and a stop 33 positioned so that lug 28 comes into abutment thereagainst when the seat is in its raised position.

Cables 29 and 31 cooperated with guides 34 and 35 judiciously positioned so that springs 30 and 32 extend vertically whatever the heightwise position of the bowl. Their length is chosen so that cable 29 stretches as soon as the bowl moves away from its low position and so that cable 31 stretches before the bowl reaches its top position.

Insofar as spring 30 is concerned, it is more resistant than spring 32, so that it stretches after spring 32, when lug 28 is in abutment against stop 33.

When water is fed into the flexible hydraulic cylinder, the bowl rises and immediately stretches cable 29. Lug 28 then pivots in the direction of arrow F in FIG. 1 while raising the seat.

While the bowl continues its rising motion, cable 31 stretches and stretches spring 32, whereby lug 28 abuts against stop 33 whereas spring 30 stretches until the flexible cylinder is completely full of water.

The seat 24 is then in its raised position, in which position it is slightly slanted towards the flusing system 6, as shown in FIG. 2.

If pipe 15 is now connected to the overflow of the flushing system, the water contained in the flexible hydraulic cylinder is driven into t he water cleaning circuit 1 under the weight of the bowl. This then begins to move down.

When the flexible cylinder begins to empty, spring 30 slackens first of all completely, which allows cable 29 to slacken slightly, after which spring 32 becomes slack in its turn while forcing seat 24 to slant slightly forwards, that it so say to pivot in the opposite direction to arrow F.

Cable 31 then slackens whereas cable 29, which again stretches under the action of the weight of the seat, allows this latter to come back to its low position.

It will be noted here that seat 24 may be moved manually from its lowered position to its raised position, and vice versa, despite the existence of its control means.

It will also be noted that means, not shown, could be provided for making the control means of the seat inoperative. This latter could then remain in its lowered position when the bowl is in the high position.

Figure 4:
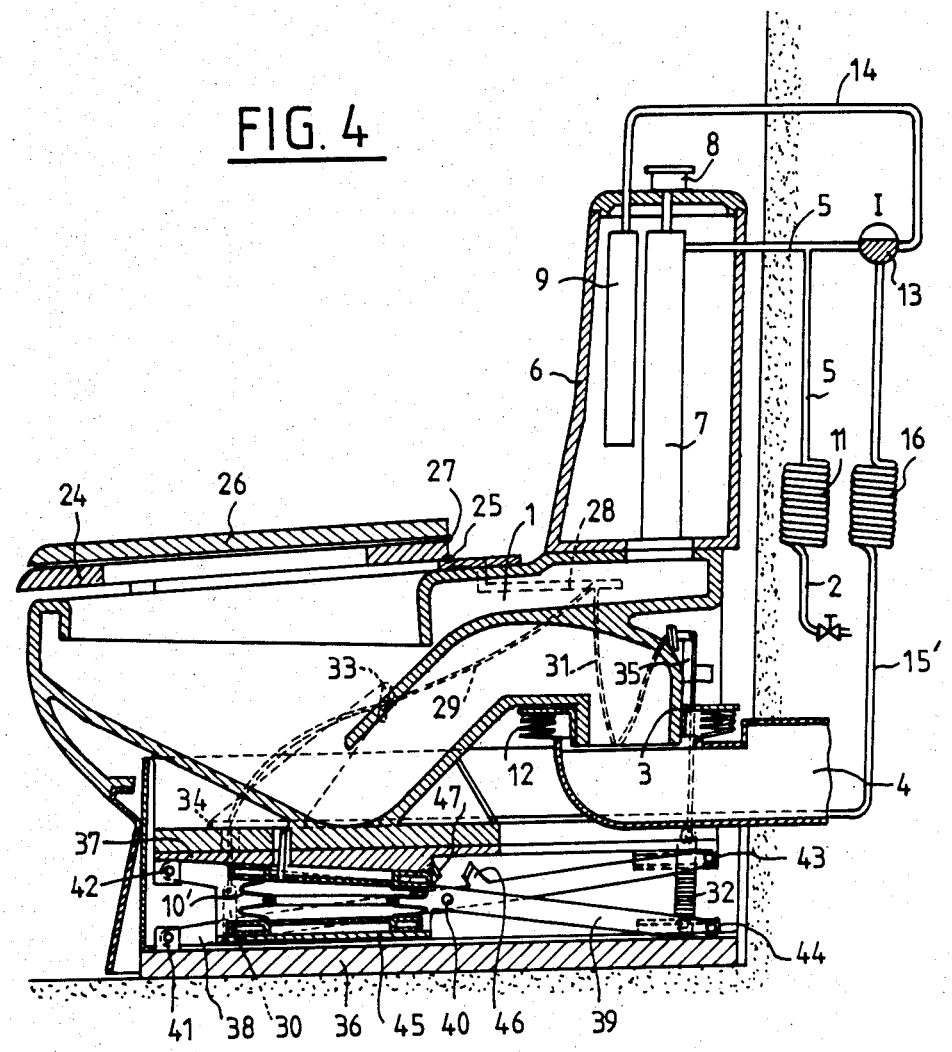
FIG. 4 is a schematical sectional view of a variant of the invention, the bowl being shown in its low position.
Figure 5:
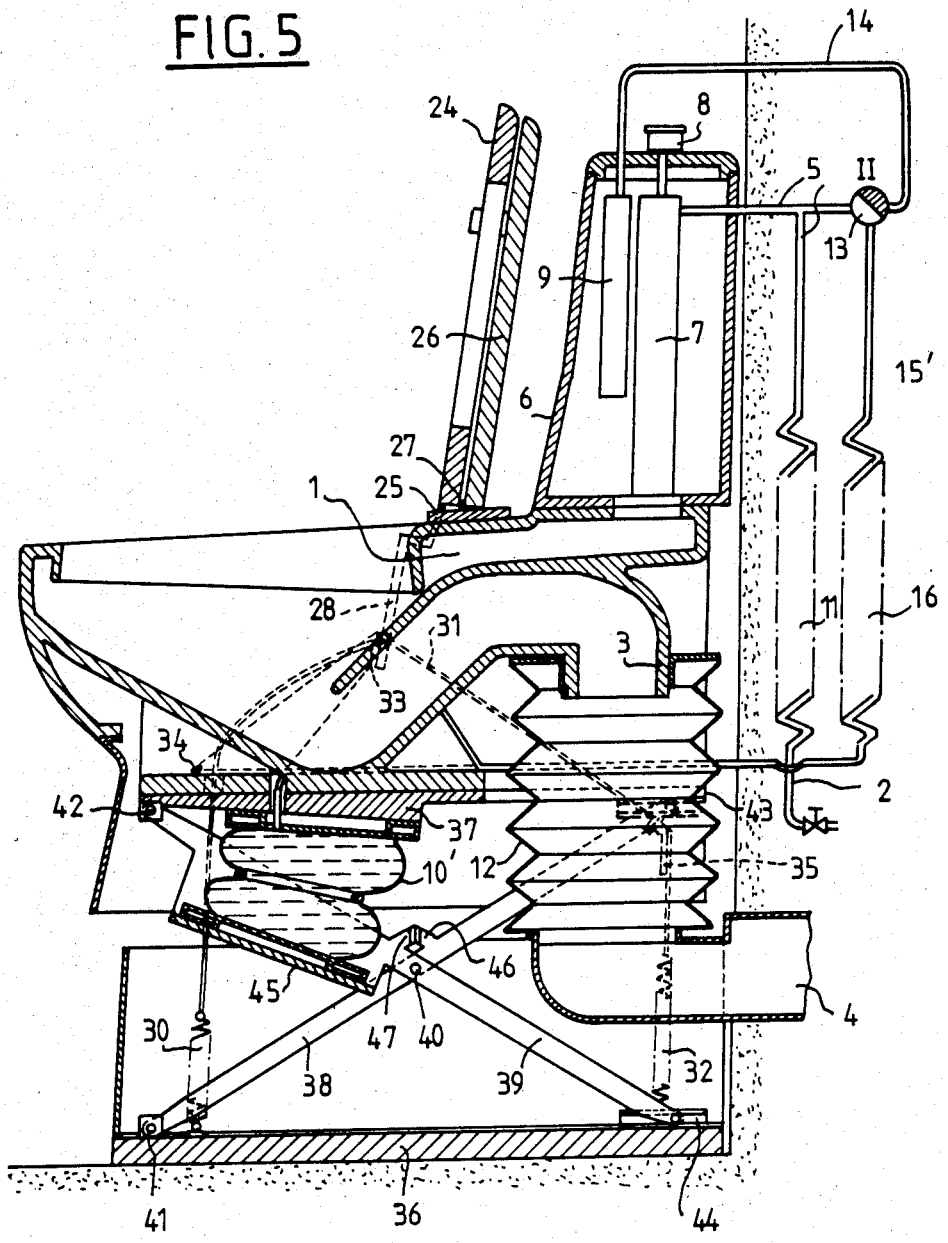
FIG. 5 is a view similar to that of FIG. 4, but showing the bowl in its high position.

The bowl show in FIGS. 4 and 5 differs from that which has just been described by the method of mounting its flexible cylinder 10', by the structure of the members for guiding it when it moves between its low and high positions, and by its anchorage to the ground without any wall support.

More precisely, it includes a base 36 resting on the ground, a plate 37 fixed under its lower face and two pairs of arms 38, 39 parallel to each other and only one of which is visible.

Arms 38, 39 of the same pair are hinged to one another about an axis 40 equidistant from their ends.

In the example shown, the front ends of arms 38, 39 are hinged respectively at 41 to base 36 and at 42 to the plate 37, whereas their rear ends are movable along slides 43, 44 fixed respectively to the plate 37 and to the base 36.

It goes without saying that the position of the hinge axis 41 and 42 could be reversed with that of slides 43 and 44 without departing from the spirit of the invention.

Moreover, the flexible hydraulic jack 10' is interposed between plate 37 and a support plate 45 connecting together the parts of arms 39 which are in front of the hinge axes 40. Pipe 15' which connects it to valve 13 opens into its upper wall and is fixed to the bowl so that the hose 16 could be omitted.

The flexible cylinder could of course be installed in a different position from that shown in FIGS. 4 and 5. Thus, it could be interposed between a plate 37 and a support plate connecting together the parts of the arms 38 which are at the rear of the hinge axes 40, between base 36 and a support plate connecting together the parts of arms 38 which are in front of the hinge axes 40 or between base 36 and a support plate connecting together the parts of arms 39 which are at the rear of the hinge axes 40.

It will be further noted that arms 38 and 39 include lugs 46, 47 adapted to come into contact and to form end of travel stops when the bowl reaches it stop position shown in FIG. 5. Thus, with these lugs, the risks that an excessive amount of water penetrates into the flexible cylinder and damages it are totally eliminated.

The operations to be carried out for height adjustment of the bowl shown in FIGS. 4 and 5 are the same as those which must be carried out for moving the bowl shown in FIGS. 1 and 2 and have therefore not been described here. It will be simply mentioned that it is sufficient to connect pipe 15' to the water supply pipe 2 for moving the bowl from its low position shown in FIG. 4 to its high position shown in FIG. 5, and to pipe 14 so as to allow the bowl to come back to its low position under the action of its own weight.

The two bowls described above can be used in individual houses, apartments, hotels, clinics, hospitals, old people's homes and any public place where a greater cleanliness of the premises and of the apparatus is desired, or where assistance to handicapped or aged persons is a constant preoccupation.

They may be provided in new installations or during renovation of bathrooms. Special connections may be provided for facilitating the replacement of an existing installation when this latter complies with the most general standards and patterns, whether it is a question of a bowl with horizontal or vertical outlet. This has the advantage of allowing traditional bowls to be replaced at a lower cost, rapidly, without appreciable work and without specialized workmen.

The bowls in themselves may be made from porcelain, from a plastic material or form any other rigid material and if required include a crusher installed in the discahrge duct.

What is claimed is:

1. A toilet bowl including a water actuated hydraulic cylinder (10;10') for moving it between a low position and a high position, a cleaning water circuit (1) adapted to be connected to a water supply pipe (2), hose (11) interposed between the cleaning water circuit (1) and the water supply pipe (2), and an outlet pipe (3) connected to a discharge duct (4) through an extensible pipe (12), characterized in that the water actuated hydraulic cylinder (10;10') is a flexible cylinder connectable selectively to the water supply pipe (2) and to the water cleaning circuit (1) through a three position valve (13), a pipe (16) being interposed between the flexible cylinder and the three position valve.

2. The toilet bowl according to claim 1, characterized in that it includes a fixed base (18) having stops (19), for supporting it when it is in its low position and vertical guide means (20) for guiding it during its movements between its low and high positions, the flexible cylinder (1) being interposed between the bowl and the fixed base.

3. The toilet bowl according to claim 1, characterized in that the flexible cylinder (1) includes a travel limiter (17) interposed between its upper and lower walls, this travel limiter being formed by a cable stretching when the bowl reaches its top position.

4. The toilet bowl according to claim 1, characterized in that it includes, between a base (36) resting on the ground and the plate (37) fixed under its lower face, at least two arms (38, 39) hinged to each other about an axis (4) equidistant from their ends, the ends of these two arms which are situated on the same side with respect to this axis being hinged (at 41, 42) respectively to the base and to the plate whereas their ends which are situated on the other side with respect to said axis are movable in slides (43, 44) fixed respectively to the base and to the plate.

5. Toilet bowl according to claim 4, characterized in that it includes two pairs of arms (38, 39) parallel to each other.

6. Toilet bowl according to claim 5, characterized in that the water actuated cyliner (10') is interposed between a support plate (45) connecting two parallel arms together and one of the elements of the group including the base (36) and the plate (37).

7. Toilet bowl according to claim 4, characterized in that the two arms (38, 39) of the same pair include lugs (46, 47) shaped so as to come into contact and form end of travel stops when the bowl reaches its top position.

8. Toilet bowl according to claim 1, including a seat (24) mounted for pivoting between a lowered position and a raised position, characterized in that control means are provided for causing the seat (24) to pivot from its lowered position to its raised position when the flexible cylinder (10) moves the bowl from its low position to its high position, and in the reverse direction when the flexible cylinder moves the bowl from its high position to its low position.

9. Toilet bowl according to claim 8, characterized in that the control means include a lug (28) extending the seat (24), rearwardly of the hinge axis (25) thereof, a first cable (29) one of the ends of which is fixed to the lug (28) and the other end of which is connected to a first fixed spring (30) adjacent the front part of the bowl, a second cable (31) one of the ends of which is fixed to the lug (28) and the other end of which is connected to a second fixed spring (32) adjacent the rear part of the bowl, the first spring (30) being more resistant than the second one (32), and a stop (33) against which the lug (28) comes to bear when the seat (24) is in its raised position, these control means being adapted so that the first cable (29) stretches as soon as the bowl moves away from its low position, so that the second cable (31) stretches before the bowl reaches its top position, and so that the first spring (30) stretches after the second one (32), when the lug (28) comes into abutment against the stop (33).

* * * * *